US006338265B1

(12) United States Patent
Grigg

(10) Patent No.: US 6,338,265 B1
(45) **Date of Patent: *Jan. 15, 2002**

(54) DEVICE FOR STRAIGHTENING ALUMINUM FINS

(76) Inventor: Jimmy Raider Grigg, R.R. 1, Box 60, Fairfax, OK (US) 74637

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/522,028

(22) Filed: Mar. 9, 2000

(51) Int. Cl.[7] ..... B21J 13/08
(52) U.S. Cl. ..... 72/458; 29/402.19; 29/890.031
(58) Field of Search ..... 29/727, 402.19, 29/890.031, 402.01; 72/479, 457, 458, 710; 30/45, 277.4, 210, 216, 172

(56) References Cited

U.S. PATENT DOCUMENTS 2,618,185 A * 11/1952 Fechter ..... 72/458
2,912,888 A * 11/1959 Webb ..... 72/457
3,041,900 A * 7/1962 Wagner ..... 72/457
3,531,975 A * 10/1970 Lance ..... 72/457
3,707,087 A * 12/1972 Neilsen ..... 72/429
4,160,177 A * 7/1979 Ascoli ..... 310/22
4,432,117 A * 2/1984 Iskiw ..... 452/98
4,979,303 A * 12/1990 Han ..... 30/216
5,787,587 A * 8/1998 Wahl et al. ..... 30/210

* cited by examiner

*Primary Examiner*—S. Thomas Hughes
*Assistant Examiner*—T. Nguyen
(74) *Attorney, Agent, or Firm*—Molly D. McKay

(57) ABSTRACT

A device for straightening metal fins on heat exchangers used in air conditioning and refrigeration systems. The device is comprised of interchangeable, detachable combs that are made to vibrate by an electrically powered vibrator. The vibrating combs can be moved easily between the adjacent fins to straighten them without requiring the force that is needed with a stationary non-vibrating comb. Various sizes of combs are provided for attachment to the vibrator.

2 Claims, 1 Drawing Sheet

22
14
18
20
10
26
30
16
26
24
12
28

14
18
16
20
10
26
22
30
24
12
28

22
14
32
20
10A
26
16
30
26
24
18
12A
28

32
18
14
20
10A
26
22
16
30
24
12A
28

36
26
22
14
34
10B
26
18
24
16
20
28
12
26
38

DEVICE FOR STRAIGHTENING ALUMINUM FINS

BACKGROUND OF THE INVENTION

1. Field of the Invention

The present invention relates to a device for combing, straightening and cleaning the metal fins on heat exchangers that are used in condensers and evaporators for air conditioning and refrigeration systems.

2. Description of the Related Art

The heat exchangers for condensers and evaporators for air conditioning and refrigeration systems are provided with numerous metal fins that increase the heat transfer from the cooling coils in the units to the atmosphere. The condensers for air conditioning systems are generally located in unprotected locations on the outside of a building. The metal fins on the condensers are often bent by impacts from hail or garden equipment such as lawn mowers. When the fins are bent, they become less efficient at transferring heat from the cooling coils in the units to the atmosphere. For this reason, it is desirable to straighten the fins back to their original configuration.

The prior method for straightening metal fins on heat exchangers involved the use of a stationary comb with teeth that were manually pulled down between the adjacent metal fins. Straightening metal fins with a stationary comb requires the use of considerable force and is a difficult and time-consuming task.

SUMMARY OF THE INVENTION

The present invention is a new device for straightening metal fins with a vibrating comb. The vibrating comb moves easily between the adjacent fins and straightens them without requiring the force that is needed with a stationary, non-vibrating comb.

The vibration for the device is provided by a vibrator located in the base of the device. The vibrator is powered either by electric line current or a battery installed in the base of the device. The user may adjust the speed of vibration with a dial located on the base of the device.

The device is provided with several different sizes of interchangeable, detachable combs to accommodate different spacing between metal fins.

DETAILED DESCRIPTION OF THE PREFERRED EMBODIMENT

Device for Straightening Aluminum Fins

Figure 1:
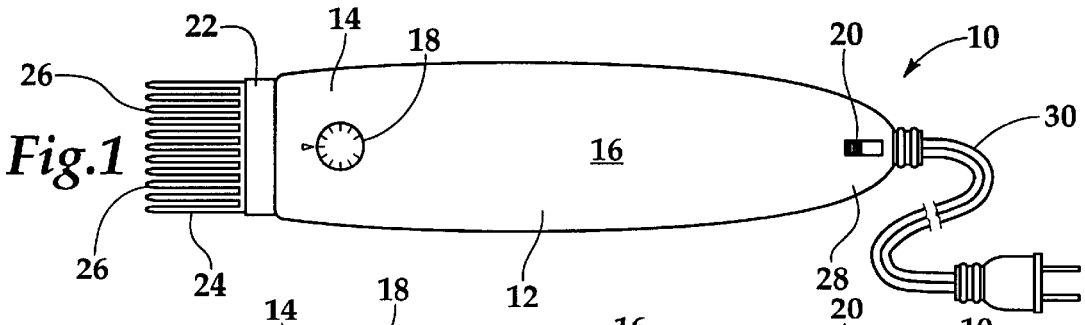
FIG. 1 is a top plan of a device for straightening aluminum fins according to a preferred embodiment of the present invention.
Figure 2:
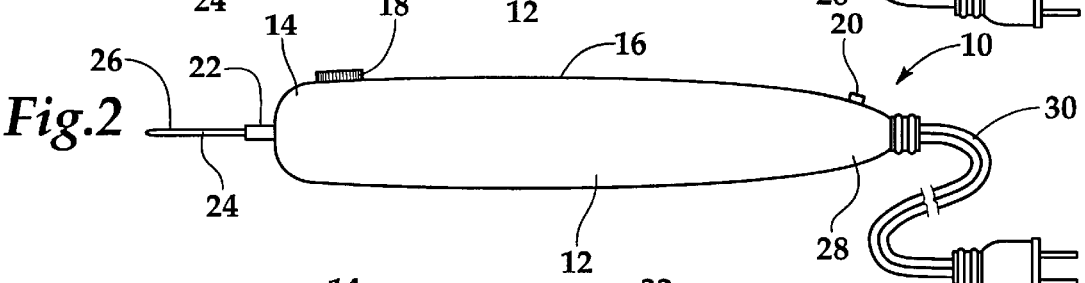
FIG. 2 is a left side view of the device of FIG. 1.

Referring now to FIGS. 1 and 2, a preferred embodiment 10 of a device for straightening aluminum fins is illustrated.

Figure 5:
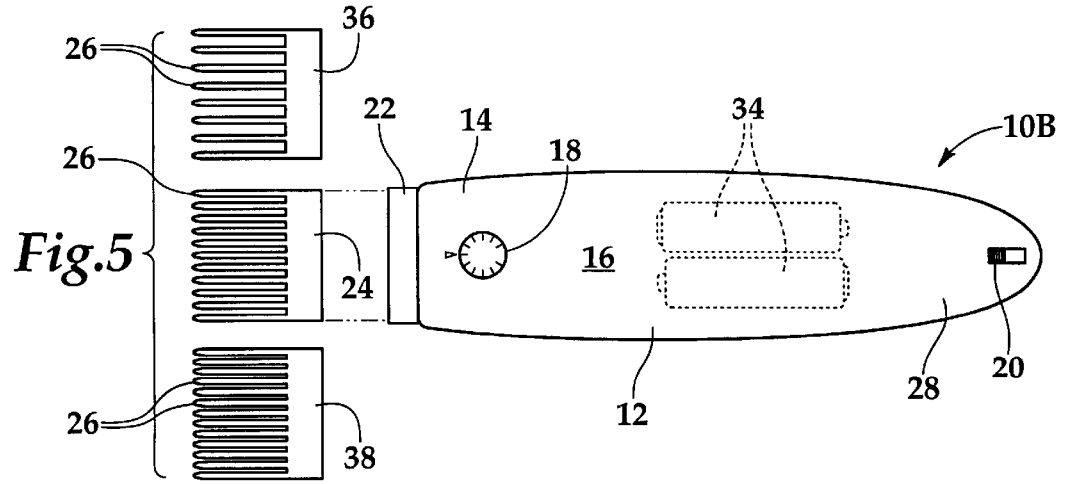
FIG. 5 is a top plan of a second alternate embodiment of the present invention having internal batteries as a power source and showing detachable combs that may be inserted into the base of the device.

The device 10 is comprised of a vibrator base 12 in which an electric-powered vibrator (not illustrated) is contained. The vibrator is not illustrated because it employs known technology similar to that found in hand held massages vibrators and hand held vibrating sanders. On a distal end 14 of a top surface 16 of said base 12 is a dial 18 for controlling the speed of the vibrator. A switch 20 for turning said device 10 on and off is provided on the top surface 16 of an opposite proximal end 28 of the base 12. Extending from the distal end 14 of said base 12 is a fastener 22 to which a detachable comb 24 may be attached. The comb 24 consists of a number of spaced apart, parallel teeth 26. Referring now to FIG. 5, three interchangeable detachable combs 24, 36, and 38 are illustrated. The three combs 24, 36, and 38 each have spaced apart, parallel teeth 26, but the spacing of adjacent teeth 26 is further apart on comb 36 and closer together on comb 38. Referring again to the device 10 of FIGS. 1 and 2, on the proximal end 28 of said base 12 is an electrical cord 30 through which electrical power is supplied to the vibrator.

Figure 3:
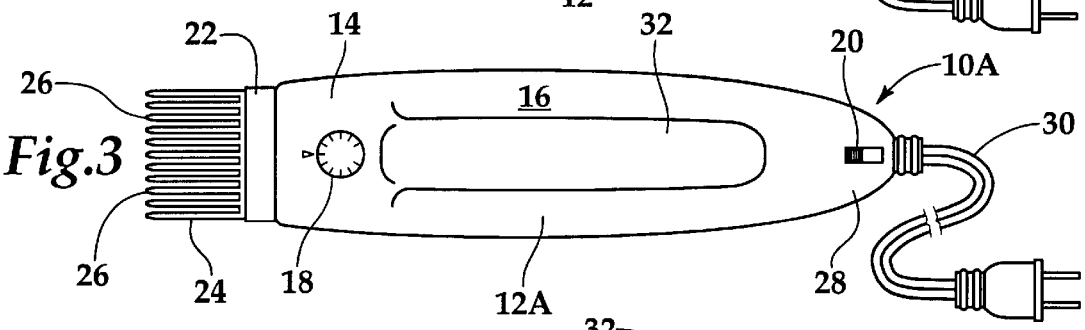
FIG. 3 is a top plan of a first alternate embodiment of the present invention having a handle for grasping the device.
Figure 4:
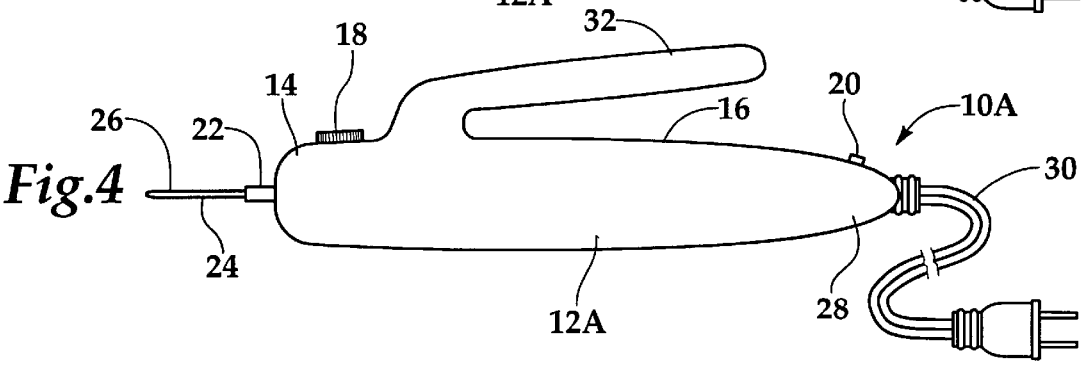
FIG. 4 is a left side view of the first alternate embodiment of FIG. 3.

Referring now to FIGS. 3 and 4, a first alternate embodiment 10A of a device for straightening aluminum fins is illustrated. The first alternate embodiment 10A is identical to the previously described preferred embodiment 10 illustrated in FIGS. 1 and 2 except that the first alternate 10A includes a handle 32 located on the top surface 16 of an alternate base 12A for grasping said device 10A.

Referring now to FIG. 5, a second alternate embodiment 10B of a device for straightening aluminum fins 10B is illustrated. The second alternate embodiment 10B is identical to the previously described preferred embodiment 10, illustrated in FIGS. 1 and 2, except that the second alternate embodiment 10B does not include the electrical power cord 30 on the proximal end 28 of the base 12, but instead the base 12 contains a battery power source 34 to supply electrical power to the vibrator.

The above description refers specifically to a device for straightening aluminum fins, but the invention includes devices for straightening fins made from any type of metal as long as the fins are sufficiently malleable to be straightened using a comb.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for straightening metal fins consisting of:

a base that contains a vibrator connected to an electrical power source, a comb with a plurality of parallel teeth extending from said comb, said comb is attached to said base so that said comb is vibrated, and said teeth removably inserted between adjacent metal fins so that the teeth engage the metal fins and straighten the metal fins as the comb vibrates.

2. A device according to claim 1 wherein said comb is removably attached to said base.

* * * * *